United States Patent [19]

Mullen

[11] 4,043,694

[45] Aug. 23, 1977

[54] VIBRATORY COMPACTOR

[75] Inventor: Larry P. Mullen, Salina, Kans.

[73] Assignee: Scientific Engineering, Inc., Salina, Kans.

[21] Appl. No.: 688,968

[22] Filed: May 24, 1976

Related U.S. Application Data

[63] Continuation-in-part of Ser. No. 587,218, June 16, 1975, abandoned.

[51] Int. Cl.[2] ..... E01C 19/34

[52] U.S. Cl. ..... 404/133

[58] Field of Search ..... 404/133, 117, 113, 116

[56] References Cited

U.S. PATENT DOCUMENTS

| | | | |
|---|---|---|---|
| 3,024,861 | 3/1962 | Clynch | 404/133 X |
| 3,108,519 | 10/1963 | Domenighetti | 404/117 |
| 3,128,682 | 4/1964 | Thompson | 404/113 |
| 3,283,678 | 11/1966 | Domenighetti | 404/117 |
| 3,749,506 | 7/1973 | Lance | 404/133 |
| 3,832,081 | 8/1974 | Opderbeck | 404/133 |

*Primary Examiner*—Nile C. Byers

*Attorney, Agent, or Firm*—Schmidt, Johnson, Hovey & Williams

[57] ABSTRACT

A self-inflating, cushioned, shock-absorbing compacting apparatus especially adapted for mounting onto the boom of a backhoe tractor is provided which ensures that a large proportion of the vibratory reaction forces and shocks attendant to earth-tamping or compacting operations are safely absorbed without damage to the backhoe itself or causing the operator to experience severe shocks. The apparatus includes an air-filled, multiple-ply resilient bag situated between a hydraulically actuated, reciprocable, earth-engaging compaction foot and the boom-mounting structure of the apparatus, in conjunction with a check valve permitting self-inflation of the bag when the apparatus is elevated to extend the bag. The bag provides support for the compacting foot in order to safely absorb vibratory shocks and the like over essentially all vibration frequencies and amplitudes exprienced in practice. In preferred forms, the cushioning bag completely replaces conventional springs and the like heretofore employed for shock absorption in compaction devices and provides the sole support for the compaction foot and related apparatus.

12 Claims, 5 Drawing Figures

VIBRATORY COMPACTOR

This is a continuation-in-part of identically-titled Application Ser. No. 587,218, filed June 16, 1975, now abandoned.

This invention relates to compacting apparatus of the type designed for mounting on the boom of a mobile tractor such as a backhoe digger. More particularly, it is concerned with compacting apparatus which includes cushioning means in the form of an air-filled, self-inflating, resilient bag or tire which is operable to safely absorb a large measure of the vibratory reaction forces and shocks normally generated during compacting or tamping operations.

Many backhoe diggers and similar mobile tractors are provided with accessory compacting heads which can be mounted on the tractor boom as needed for earth compacting operations, e.g., when refilled ditches or the like are to be tamped. Such compacting heads normally include a generally planar, earth-engaging compacting foot and a hydraulic motor for reciprocating the foot at high frequency in order to provide the necessary compacting action. During earth compacting operations with such boom-mounted heads, potentially destructive vibratory shocks are generated by virtue of reaction forces and shocks developed as the foot repeatedly strikes the earth. These vibrations can cause severe mechanical problems to the tractor itself and also repeatedly jar the operator. For example, many backhoe diggers fitted with conventional compacting heads have been known to experience premature failure of the boom mounting bearings along with other untoward mechanical effects.

In response to these problems, it has been suggested to employ resilient springs in the compacting head for absorbing at least a portion of the vibratory forces and shocks without transmittal thereof to the boom and tractor apparatus. While such expedients have reduced the above problems to a limited degree, they have not really provided a successful answer to the problems of compactor vibration. Thus, workers in the art have been searching for ways to more efficiently and safely handle the vibration problems plaguing the use of compactor heads for backhoe diggers and the like.

Fluid-filled shock-absorbing bags have also been proposed for use in compacting heads; see, for example, U.S. Pat. No. 3,024,861. Such bags are normally provided with a tire-type valve permitting filling thereof with air. However, during high frequency earth compacting operations, it is inevitable that such bags lose air, no matter how tightly the bags are sealed. Consequently, shock-absorbing efficiency of such prior bags decreases during use, thereby necessitating refilling of the bags. While this can be accomplished without difficulty if a supply of compressed air is at hand, in the field such refilling equipment is often not available.

It is therefore the most important object of the present invention to provide cushioned compacting apparatus of simplified construction which is especially adapted for boom-mounting and ensures that a large proportion of the reaction forces and vibrations generated during earth tamping or compacting operations are safely absorbed without damage to the boom or associated apparatus.

As a corollary to the foregoing, another aim of the invention is to provide cushioned compacting apparatus including a fluid-filled, resilient bladder or bag strategically located in the compacting apparatus for safely and efficiently absorbing vibratory shocks over essentially all vibration frequencies and amplitudes encountered in practice; in preferred forms, the bag also serves as a support for the compacting foot and is provided with check valve means for permitting the bag to self-inflate upon elevation of the apparatus sufficient to extend the bag, so that the need for compressed air or the like at the worksite for filling of the bag is eliminated.

Figure 1:
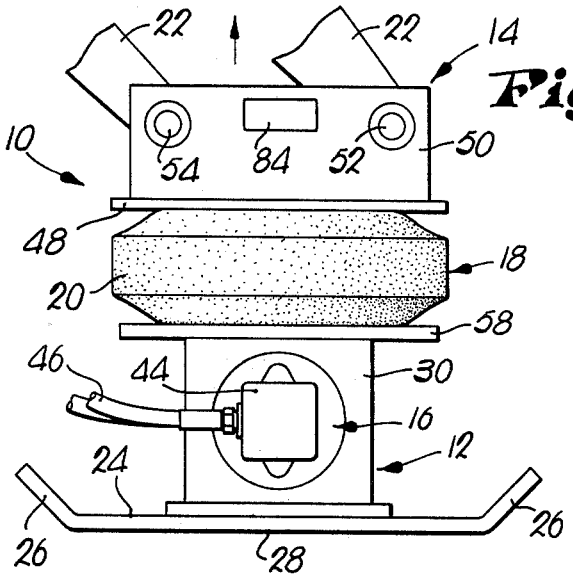
FIG. 1 is an elevational view of compacting apparatus in accordance with the invention mounted on the boom of a backhoe and with the head in its elevated, self-inflating position.

The compacting apparatus 10 of the present invention broadly includes earth-engaging compacting structure 12, attachment means 14 for securing apparatus 10 to a boom or the like, selectively actuatable motor means 16 for high frequency reciprocation of structure 12 during tamping operations, and interconnecting and cushioning means 18 including an air-filled, resilient, multiple-ply tire or bag 20, which is operable to absorb at least a part of any reaction forces and shocks developed during operation of apparatus 10.

Although forming no part of the present invention, it is to be understood that apparatus 10 is especially adapted for use with a powered backhoe digger having a hydraulically actuated knuckleboom or "dipstick" (not shown). The outermost connection arms 22 (see FIGS. 1 and 2) of the boom are pivotally connected to apparatus 10 and support the latter above an area of earth 23 to be compacted.

In more detail, structure 12 of apparatus 10 preferably is in the form of a relatively massive compacting foot 24 having integral, upstanding fore and aft marginal sections 26 and a generally planar compacting surface 28 on the underside thereof.

Figure 4:
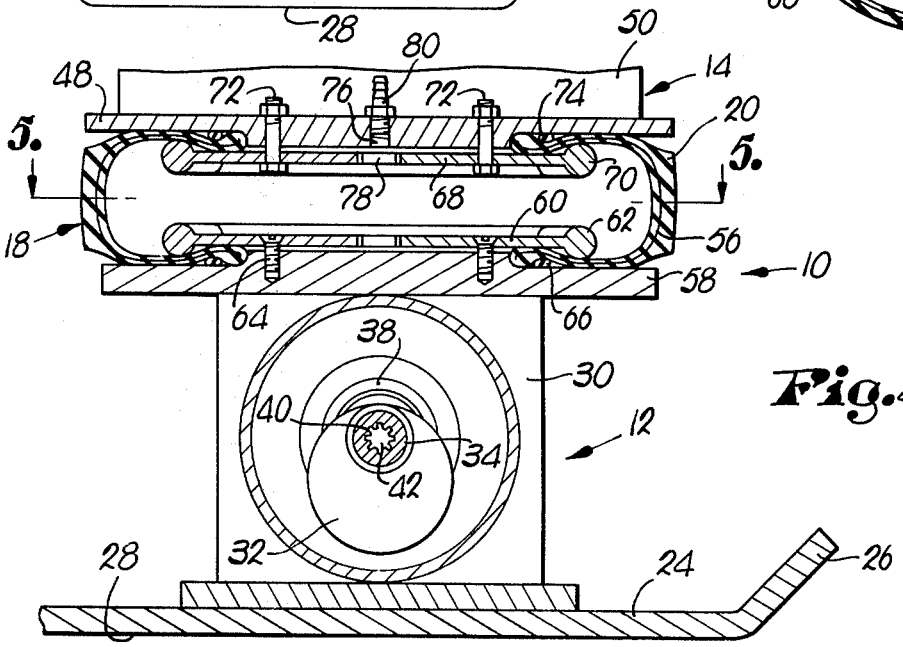
FIG. 4 is an enlarged, vertical sectional view of the compacting apparatus and illustrating the internal details of construction thereof.

An apertured eccentric housing 30 is mounted on the upper surface of foot 24 and receives an elongated, transversely extending rotatable eccentric 32 (see FIG. 4). Eccentric 32 includes an elongated, annular mounting shaft 34 which is offset from the geometric center of the eccentric and is received at respective ends thereof within complemental bearings of opposed bearing assemblies 36 and 38. The end of shaft 34 seated within assembly 38 is splined as at 40 for the operative reception of complementally configured drive shaft 42. In this regard, assembly 38 is apertured to receive the elongated, complementally splined shaft 42 forming a part of an exteriorly mounted hydraulic motor 44 which serves as a prime mover for eccentric 32. In this manner, powered rotation of shaft 42 correspondingly rotates eccentric 34, which in turn causes rotation of housing 30 and underlying foot 24 connected thereto, so that the foot reciprocates in a direction generally toward and away from the free end of the supporting boom. Actuation of hydraulic motor 44 is selectively controlled through hand controls mounted on the backhoe and hydraulic lines 46, all as is conventional in the art.

Attachment means 14 is in spaced relationship to housing 30 and foot 24 and includes a lowermost, generally horizontally disposed, circular, apertured plate 48. A pair of spaced, upstanding, apertured mounting elements 50 are secured atop plate 48 and received therebetween the outermost arms 22 of the digger boom. The arms 22 are pivotally secured to the elements 50 by means of transversely extending pins 52 and 54. Bag or tire 20 preferably includes from eight to twelve plies 56 (see FIG. 4) of reinforcing material and presents a circumscribing, cylindrical outer wall and spaced, annular, inwardly extending sidewalls. In preferred forms, bag 20 represents the sole connective element between attachment means 14 and eccentric housing 30.

Referring now to FIG. 4, it will be seen that a generally planar, horizontally disposed, circular mounting plate 58 is attached to the upper end of eccentric housing 30. The lower annular sidewall of bag 20 is secured to plate 58 by means of a segmented, three-piece circular mounting plate 60 which cooperatively presents a peripheral, bag-engaging bead 62. A plurality of screws 64 are employed for removably attaching plate 60 to plate 58 in a manner to sealingly engage and hold the annular sidewall of bag 20 therebetween. In addition, an annular, resilient sealing ring 66 is interposed between plate 58 and the adjacent sidewall of bag 20.

The upper sidewall of bag 20 is similarly secured to lowermost plate 48 of attachment means 14. In this case, segmented circular plate 68 having circumferential beading 70 is attached to plate 48 by means of bolt and nut assemblies 72, with the upper sidewall of bag 20 interposed between the beading 70 and plate 48. A sealing ring 74 is disposed between plate 48 and the sidewall of bag 20 in order to further enhance the integrity of the seal.

Figure 3:
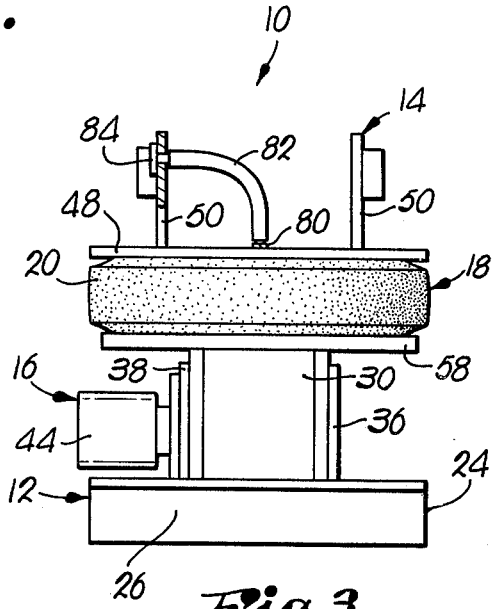
FIG. 3 is a front elevational view of the compacting apparatus shown in its normal rest position.

Plates 48 and 68 are centrally apertured as at 76 and 78 in order to define an air inlet leading to the interior of bag 20. As best seen in FIGS. 3 and 4, a threaded hose fitting 80 is mounted within aperture 76. An air hose 82 ( FIG. 3) extends between fitting 80 and a conventional, flapper-type check valve 84 mounted on one of the upstanding elements 50.

In operation, the backhoe digger having compacting apparatus 10 attached to the boom thereof is moved adjacent to area 23 to be compacted, and the boom is shifted so that apparatus 10 is proximal to the area. At this point, the operator can manipulate the conventional hydraulic controls in order to actuate motor 44. This in turn causes rotation of drive shaft 42 and consequent rotation of eccentric 32 and corresponding up-and-down reciprocal movement of foot 24. During such high frequency reciprocation of foot 24, bag 20 is successively compressed and relaxed. The frequency of foot reciprocation depends principally upon the capabilities of motor 44, but conventionally will vary from about 500 to 2,500 cycles per minute. In any event, the resulting high frequency contact between foot 24 and area 23 to be compacted serves to effectively tamp the latter.

During such repeated compacting contact between foot 24 and the earth, it will be appreciated that substantial reaction forces, shocks and vibrations are developed. These vibratory shocks and the like are in large measure absorbed by resilient bag 20 which is operable to compress and relax as necessary for this purpose. In addition, use of a multiple-ply industrial tire for bag 20 provides substantial shear-resistance and makes it possible to operate apparatus 10 without limit chains or the like between attachment means 14 and the lower operating portions of the apparatus.

Figure 2:
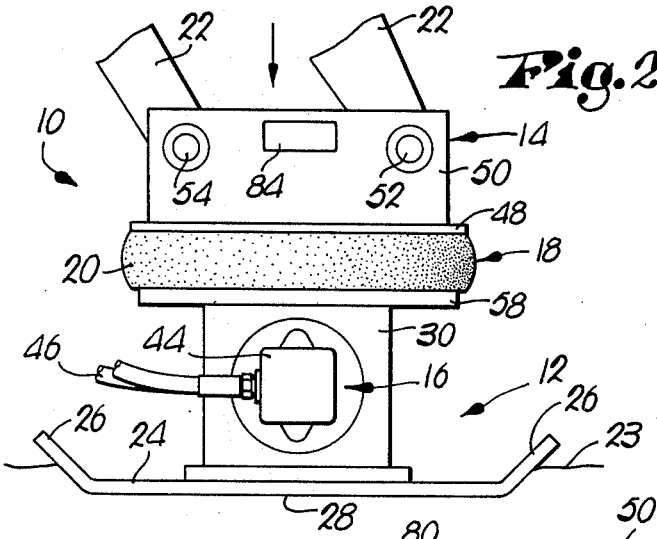
FIG. 2 is an elevational view similar to that of FIG. 1 but showing the compacting apparatus during use thereof with the shock-absorbing bag or tire in its compressed condition.
Figure 5:
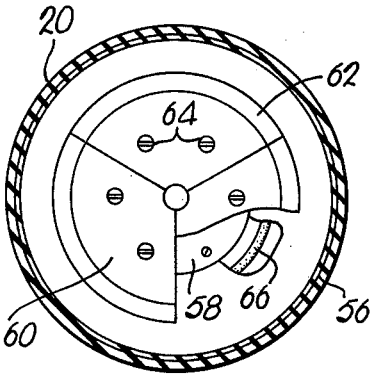
FIG. 5 is a sectional view taken along line 5—5 of FIG. 4 with parts broken away for clarity.

Finally, provision of check valve 84 and related structure permits bag 20 to reinflate as necessary each time apparatus 10 is elevated to a point where bag 20 is extended. This operational configuration is illustrated in FIG. 1, and during such time, air drawn in through check valve 84 inflates bag 20 to atmospheric pressure. During compacting operations illustrated in FIG. 2, bag 20 is compressed and check valve 84 remains closed to prevent escape of air from the bag. However, the high frequency oscillation of foot 12, and the substantial reaction forces and the like developed during compacting, inevitably cause some loss of air from bag 20. In prior art devices of this type, it has been necessary to have a ready supply of compressed air or the like for refilling of the air bags; in the present invention, need for this type of equipment is completely eliminated since the bag successively reinflates as necessary during normal compacting operations.

Having thus described the invention what is claimed as new and desired to be secured by Letters Patent is:

1. Compacting apparatus, comprising:

compacting structure presenting a compacting foot;

attachment means spaced from said compacting structure for securing the apparatus to support structure therefor;

means operatively coupling said attachment means and compacting structure and supporting the latter and permitting cushioned, shock-absorbing relative motion therebetween, said coupling and supporting means including a resilient, air-filled bag situated between said attachment means and compacting structure and in operative, shock-engaging engagement with the latter for absorbing at least a portion of the vibratory forces experienced during contact between said surface and an area being compacted, there being valve means operatively connected with said bag for allowing self-inflation of said bag with atmospheric air and means operatively coupled to said compacting structure for causing reciprocation of the same in a direction generally toward and away from said attachment means, the volume of said bag, and the mass of said compacting structure, being of relative magnitudes for causing extension of the bag under the influence of said mass when the compacting structure is elevated above said area being compacted to permit air to pass into said bag from the atmosphere through said valve means, and for absorbing shocks when said compacting foot strikes said area being compacted.

2. Compacting apparatus as set forth in claim 1 wherein said valve means includes a one-way check valve.

3. Compacting apparatus as set forth in claim 1 wherein said bag is connected to said attachment means and compacting structure respectively for providing support for the latter.

4. Compacting apparatus as set forth in claim 3 wherein said bag provides the sole connection between said attachment means and compacting structure.

5. Compacting apparatus as set forth in claim 1 wherein said bag includes a plurality of reinforcing plies.

6. Compacting apparatus as set forth in claim 1 wherein said coupling means includes a pair of attachment plates respectively connected to said attachment means and compacting structure and in engagement with an adjacent section of said bag for securing the latter between said attachment means and compacting structure.

7. Compacting apparatus as set forth in claim 6 wherein said plates each include a circumferentially extending, bag section-engaging bead.

8. Compacting apparatus as set forth in claim 6 including a resilient seal interposed between said attachment means and compacting structure, and the corresponding adjacent bag sections.

9. Compacting apparatus as set forth in claim 1 wherein said structure comprises a plate having a generally planar compacting surface.

10. Compacting apparatus as set forth in claim 1 wherein said attachment means includes structure for mounting the apparatus on the boom of a backhoe tractor.

11. Compacting apparatus as set forth in claim 1 wherein said reciprocation means comprises:

an eccentric housing attached to said structure:

an eccentric rotatably mounted within said housing and operable upon rotation thereof to reciprocate said housing and structure in a direction generally toward and away from said attachment means; and means operatively coupled with said eccentric for selectively rotating the same.

12. Compacting apparatus as set forth in claim 11 wherein said eccentric rotating means comprises a hydraulic motor.

* * * * *